US006058542A

United States Patent [19]

Lo

[11] Patent Number: 6,058,542

[45] Date of Patent: May 9, 2000

[54] PORTABLE ELECTRIC CLEANING DEVICE

[75] Inventor: Teh-Liang Lo, 8F, No. 45, Pao-Chung Road, Hsin-Tien City, Taiwan

[73] Assignee: Teh-Liang Lo, Hsin-Tien, Taiwan

[21] Appl. No.: 09/163,324

[22] Filed: Sep. 30, 1998

[30] Foreign Application Priority Data

Aug. 20, 1998 [TW] Taiwan ..... 87113750

[51] Int. Cl.[7] ..... A46B 13/02

[52] U.S. Cl. ..... 15/28; 15/22.1; 15/23

[58] Field of Search ..... 15/22.1, 23, 28

[56] References Cited

U.S. PATENT DOCUMENTS

| | | | |
|---|---|---|---|
| 3,162,876 | 12/1964 | Aronson et al. | 15/28 |
| 3,220,039 | 11/1965 | Dayton et al. | 15/28 |
| 3,343,192 | 9/1967 | Goldstein et al. | 15/23 |
| 4,137,588 | 2/1979 | Sandt et al. | 15/28 |
| 5,235,716 | 8/1993 | Stella | 15/28 |
| 5,495,632 | 3/1996 | Baker | 15/23 |
| 5,551,114 | 9/1996 | Lee | 15/28 |
| 5,781,995 | 7/1998 | Hendricks | 15/22.1 |
| 5,956,791 | 9/1999 | Bassi et al. | 15/28 |

FOREIGN PATENT DOCUMENTS

| | | | |
|---|---|---|---|
| 853045 | 10/1952 | Germany | 15/28 |
| 110055 | 8/1979 | Japan | 15/28 |
| 096608 | 3/1988 | Taiwan . | |
| 257062 | 9/1995 | Taiwan . | |

*Primary Examiner*—Terrence R. Till
*Attorney, Agent, or Firm*—Winston Hsu

[57] ABSTRACT

The present invention relates to a portable electric cleaning device to clean various household items. The cleaning device comprises a housing, a motor, a cleaning module, and a battery set. The housing has a handle and a chassis. The motor is installed in the chassis of the housing and comprises a rotating axle. The cleaning module has a cleaning head for cleaning various home appliance and home environment, and a connecting end installed on the rotating axle. The battery set is installed in the housing for driving the motor so as to rotate the cleaning module.

47 Claims, 10 Drawing Sheets

PORTABLE ELECTRIC CLEANING DEVICE

BACKGROUND OF THE INVENTION

1. Field of the Invention

The present invention relates to a portable electric cleaning device, and more particularly, to an electric cleaning device for cleaning appliances in a rotatable manner.

2. Description of the Prior Art

Grease, dust and dirt relentlessly collect on the floor, walls and ceiling of a kitchen or bathroom making household cleaning a non-ending tiresome chore. New chemical detergents for cleaning different household items such as toilets, bathtubs, kitchen appliances or furniture are constantly coming on the market but they are only as effective as the cleaning devices with which they are used.

Most cleaning equipment on the market today such as mops, brushes and scouring pads require a high level of energy expenditure, requiring the user to clean appliances by hand. This not only requires an inordinate amount of time but also is ineffective as the user cannot thoroughly clean the appliances. Furthermore, continued use of such devices may lead to health problems of the waist and back.

SUMMARY OF THE INVENTION

It is therefore a primary objective of the present invention to provide a portable electric cleaning device to solve the above mentioned problems.

Briefly, in a preferred embodiment, the present invention provides a portable electric cleaning device comprising:

a housing having a handle and a chassis;

a motor installed in the chassis of the housing comprising a rotating axle;

a cleaning module having a cleaning head for cleaning various home appliances and home environment, and a connecting end installed on the rotating axle; and a battery set installed in the housing for driving the motor so as to rotate the cleaning module.

It is an advantage of the present invention that the electric cleaning device makes use of a spinning electric cleaning head and requires little manpower. Furthermore, there is a wide selection of different cleaning heads and handles that may be used with the electric cleaning device thus making the cleaning of household items a very simple task.

This and other objectives of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
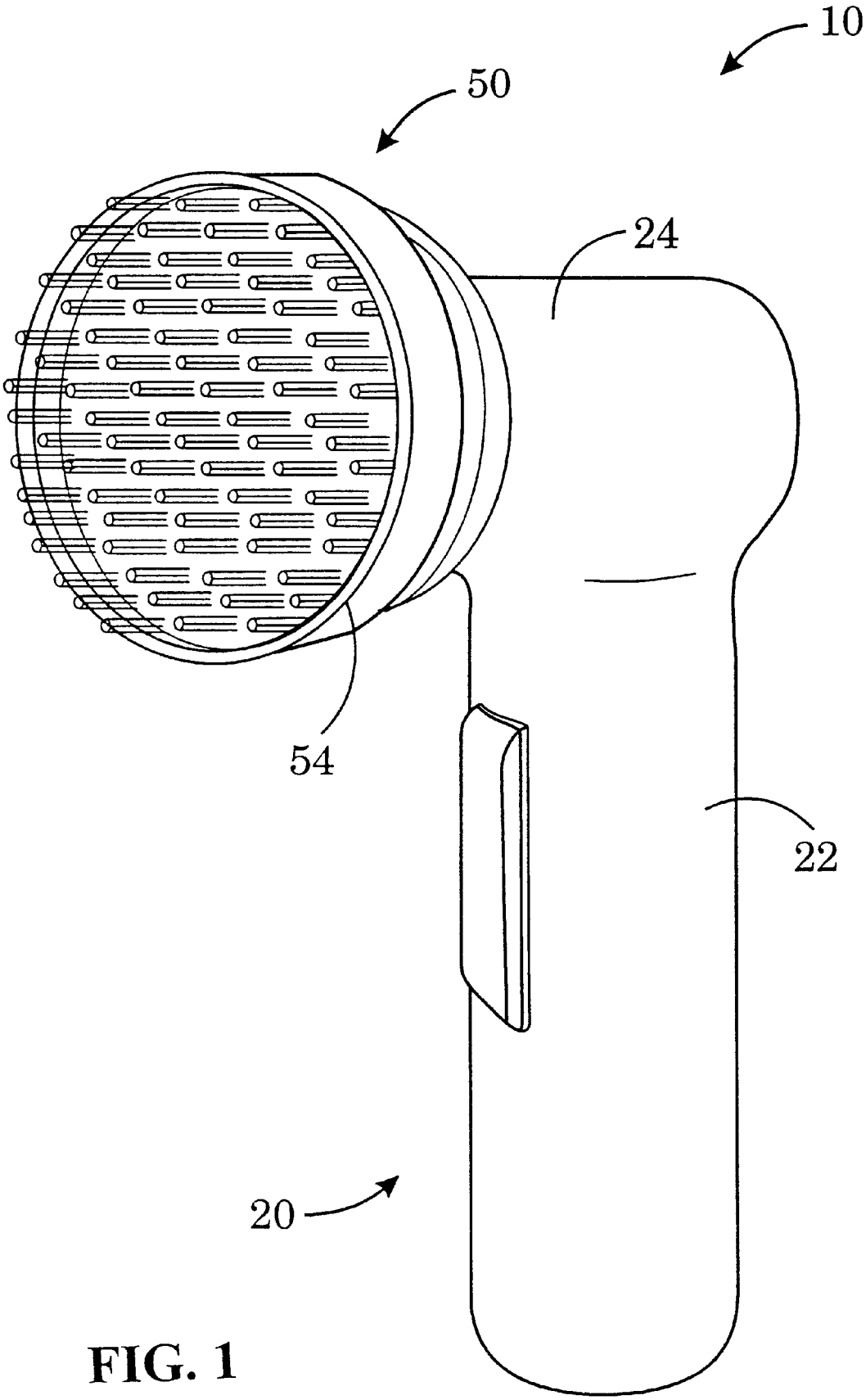
FIG. 1 is a perspective view of an electric cleaning device according to the present invention.
Figure 2:
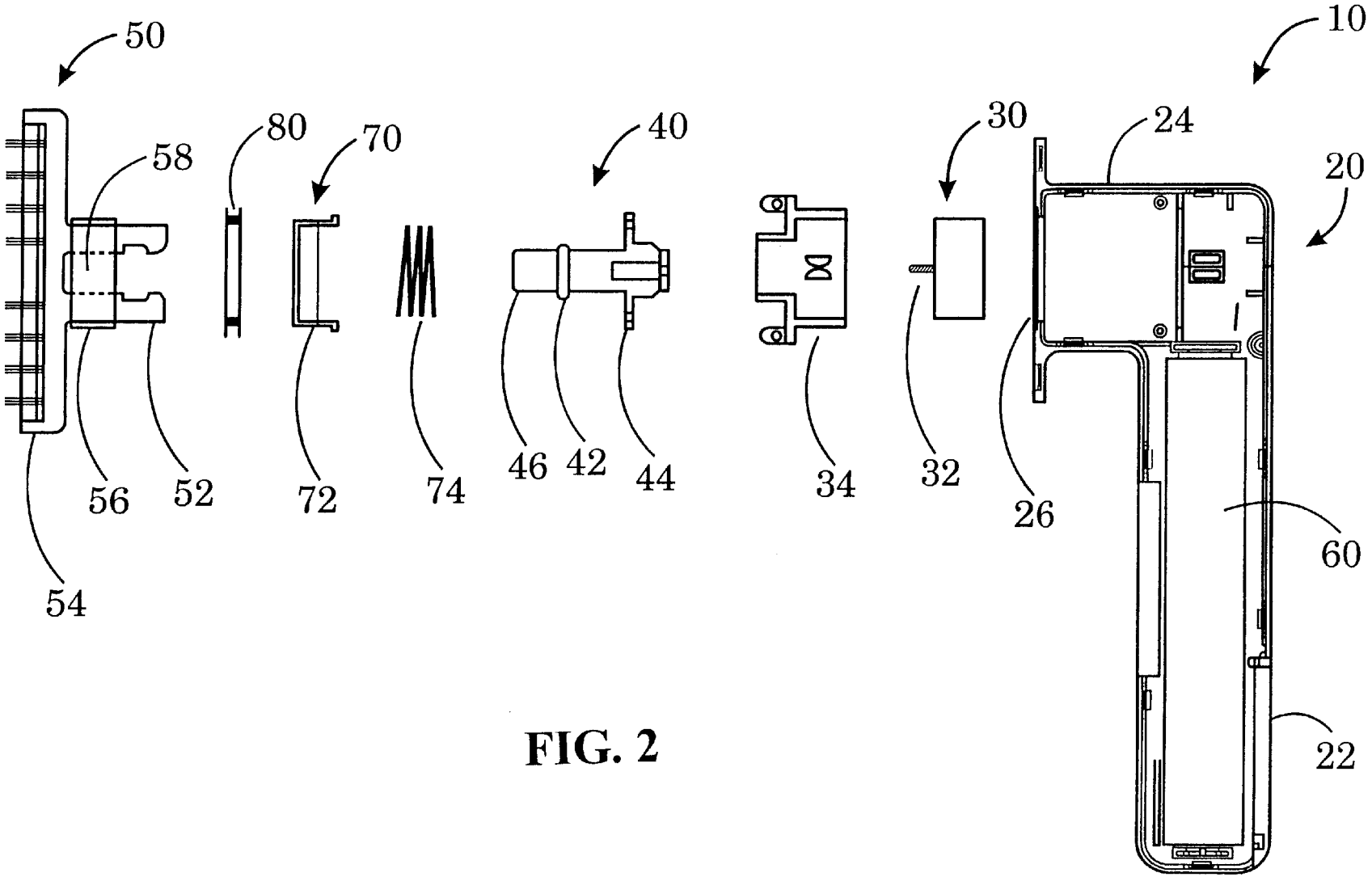
FIG. 2 is a component diagram of the cleaning device in FIG. 1.

Please refer to FIGS. 1 and 2. FIG. 1 is a perspective view of an electric cleaning device 10 according to the present invention. FIG. 2 is a component diagram of the cleaning device 10. The electric cleaning device 10 comprises a housing 20 having a handle 22 and a chassis 24, a direct current motor 30 installed in the chassis 24 of the housing 20, a rotating axle 32 protruding from a center portion of a front surface of the motor 30, a motor case 34 for fixing the motor 30 in the chassis 24, a cleaning module 50 installed on the rotating axle 32 through a transmission element 40 for cleaning various home appliances and environment, a transmission element 40 installed between the rotating axle 32 and the cleaning module 50 and mounted on the rotating axle 32 so that the motor 30 can use the transmission element 40 to rotate the cleaning module 50, an elastic device 70 elastically installed between the cleaning module 50 and the transmission element 40, and a battery set 60 installed inside the handle 22 for driving the motor 30 so as to rotate the cleaning module 50. The battery set 60 comprises a plurality of dry batteries or rechargeable batteries. The rear side of the cleaning module 50 comprises a connecting end 52 which can be directly attached to or detached from the transmission element 40. The front side of the cleaning module 50 comprises a cleaning head 54 for cleaning various home appliances. The cleaning module 50 may be attached to a wide variety of cleaning heads 54 as well as a host of other cleaning tools.

The transmission element 40 comprises a protruded edge 42, a base plate 44 with openings, and a square shaped protruded bar 46. The connecting end 52 of the cleaning module 50 comprises a plurality of elastic hooks for engaging the protruded edge 42 of the transmission element 40, and a square shaped slot 58 for insertion of the protruded bar 46 which drives the device. The elastic hooks at the connecting end 52 comprise elastic material and enable a user to directly attach the connecting end 52 of the cleaning module 50 to the transmission element 40 by hand. When the elastic hooks of the connecting end 52 are secured by the protruded edge 42, the cleaning module 50 can make slight movements relative to the transmission element 40 along an axial direction. The connecting end 52 of the cleaning module 50 can also be detached from the protruded edge 42 directly by hand.

The elastic device 70 comprises a spring 74 installed within a buffer cap 72. The rear end of the buffer cap 72 is hooked onto the base plate 44 of the transmission element 40. When the connecting end 52 of the cleaning module 50 is attached to the protruded edge 42, the connecting end 52 will be pushed against the front end of the buffer cap 72. The elastic device 70 will elastically push the elastic hooks of the connecting end 52 toward the protruded edge 42 to firmly secure the cleaning module 50 and to provide an elastic force that can prevent damage to the appliance during cleaning. Moreover, it will enhance control of the cleaning device 10 and prevent damage to the motor 30 caused by repetitive collisions.

The electric cleaning device 10 further comprises a metallic ring 80 installed on a matched opening 26 of the housing 20 between the matched opening 26 and the cleaning module 50. When the connecting end 52 of the cleaning module 50 is installed on the transmission element 40, the end of the connecting end 52 close to the cleaning head 54 of the cleaning module 50 can be fitted with another metallic ring 56 for rotatably engaging with the metallic ring 80 of the matched opening 26. The metallic ring 80 can reduce the friction generated during rotation of the cleaning module 50, and prevent wobbling of the cleaning module 50.

Figure 3:
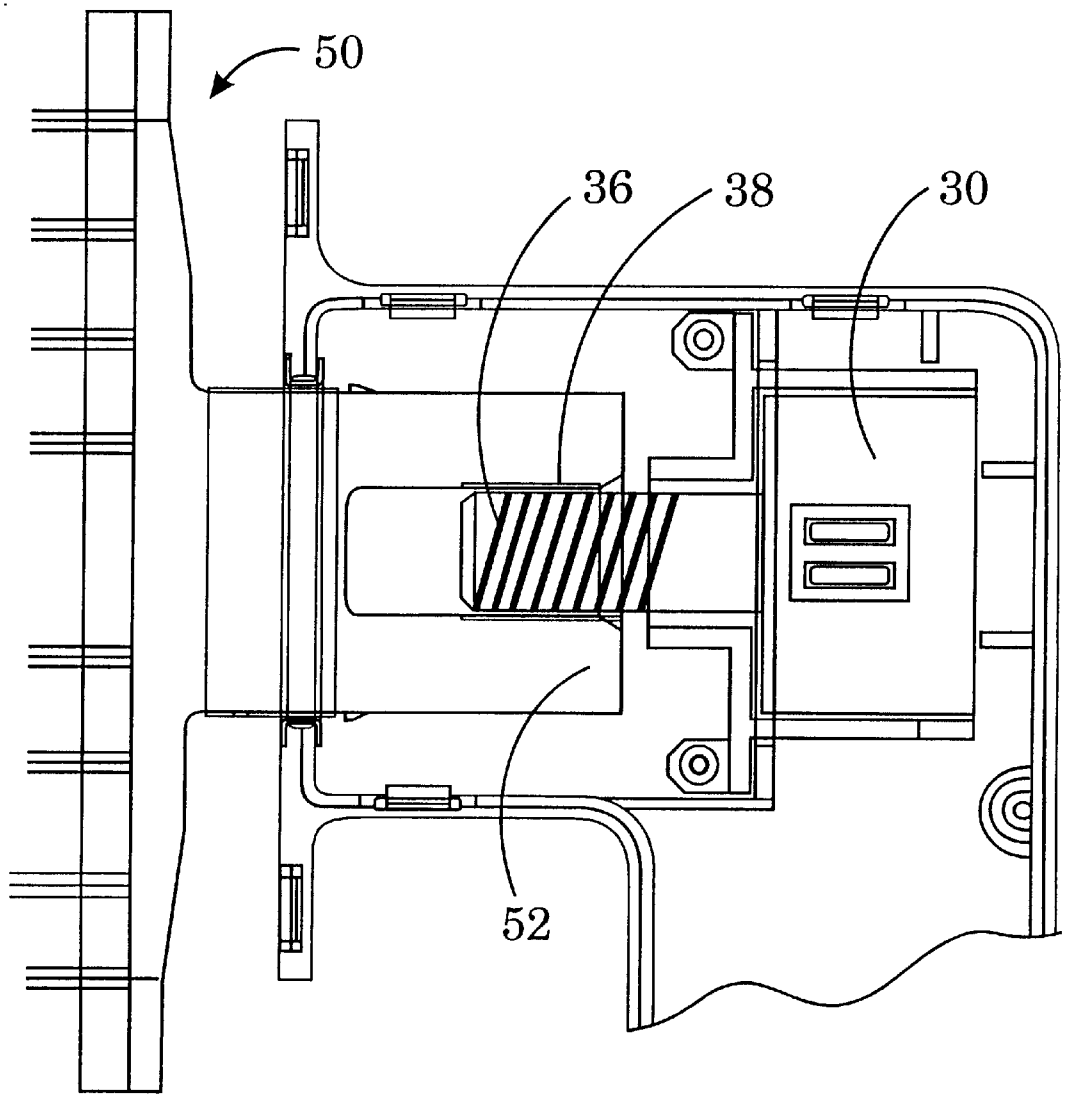
FIG. 3 shows an alternate cleaning device with its cleaning module and motor directly connected by male and female screw threading.

As shown in FIG. 3, when the connecting end 52 of the cleaning module 50 and the rotating axle 38 are installed with corresponding male and female screw threading 36, the cleaning module 50 can be directly installed on the rotating axle 38 of the motor 30, and different cleaning modules 50 can be attached to or detached from the rotating axle 38. However, the screw threading has to be made along a direction opposite to the movement direction of the cleaning module when driven by the motor to prevent loosening of the cleaning module 50. Furthermore, the connecting end 52 of the cleaning module 50 can be connected with the rotating axle 38 by way of riveting, welding or joggling.

Figure 4:
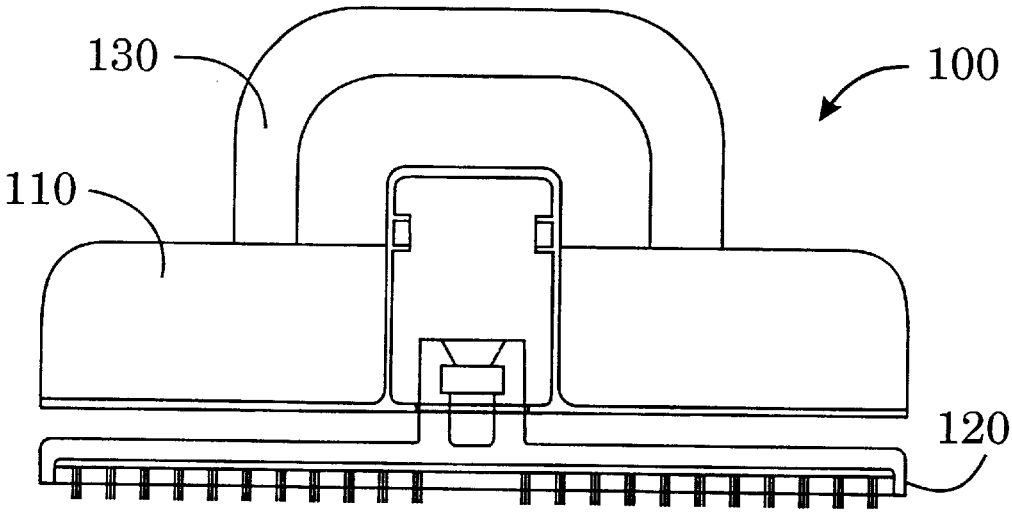
FIG. 4 is a sectional view of an electric cleaning device with a ring-shaped handle according to the present invention.
Figure 5:
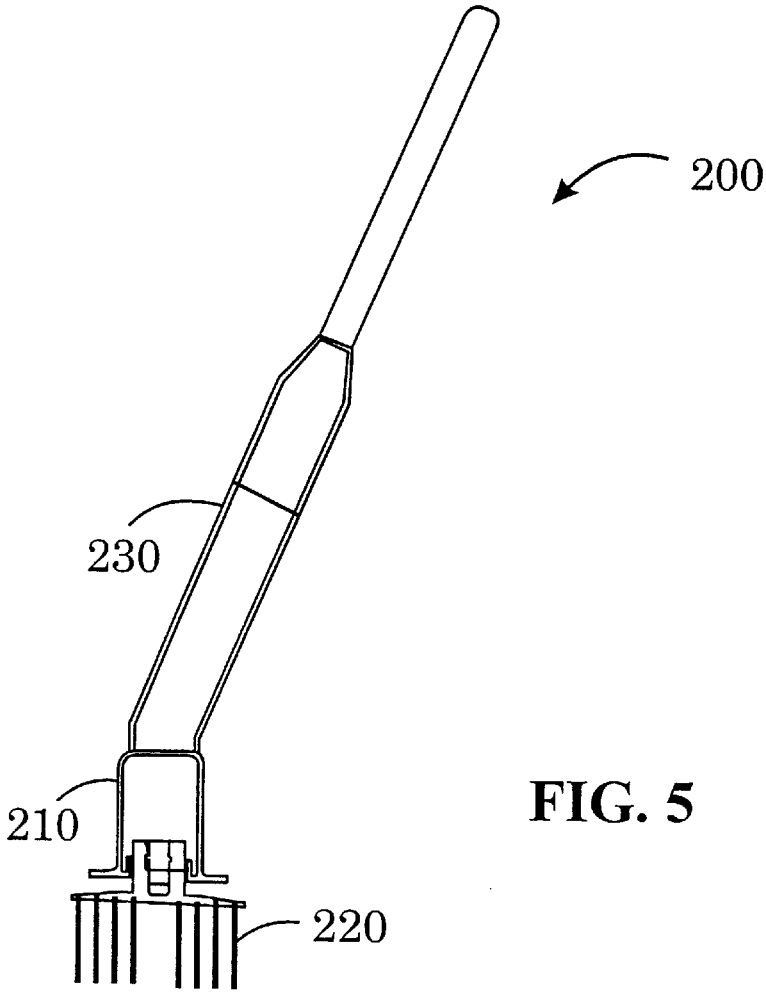
FIG. 5 is a sectional view of an electric cleaning device with a stick-shaped handle according to the present invention.

The electric cleaning device 10 can be installed with different handles 22 to satisfy different demands. Please refer to FIGS. 4 and 5. FIGS. 4 and 5 are sectional views of other electric cleaning devices 100, 200 according to the present invention. The electric cleaning devices 100, 200 differ from the electric cleaning device 10 in the shapes of the handle and chassis of the housing 20. The electric cleaning device 10 shown in FIG. 1 is used for general cleaning of home appliances, thus the handle 22 and the rotating axle 32 are nearly perpendicular, and the handle 22 is relatively short enabling the user to easily hold the handle 22 during cleaning. However, the handle 22 and the rotating axle 32 can also be designed to form an obtuse or acute angle depending on different cleaning needs. The housing of the electric cleaning device 100 in FIG. 4 comprises a handle 130 and a roughly circular shaped chassis 110 with a front end and a rear end. The cleaning module 120 is positioned at the front end of the chassis 110. The handle 130 is a ring-shaped handle fixed on the rear end of the chassis 110 so that a user can easily hold the ring-shaped handle 130 for cleaning objects with greater surface area or requiring greater manpower. The housing of the electric cleaning device 200 in FIG. 5 comprises a stick-shaped handle 230. The stick-shaped handle 230 can be manufactured in various lengths and can be made extendible. It is fixed on the chassis 210 at a predetermined oblique angle so that a user can easily hold the handle 230 for cleaning items such as toilets, ceilings, or household items in hard to reach places.

Figure 6:
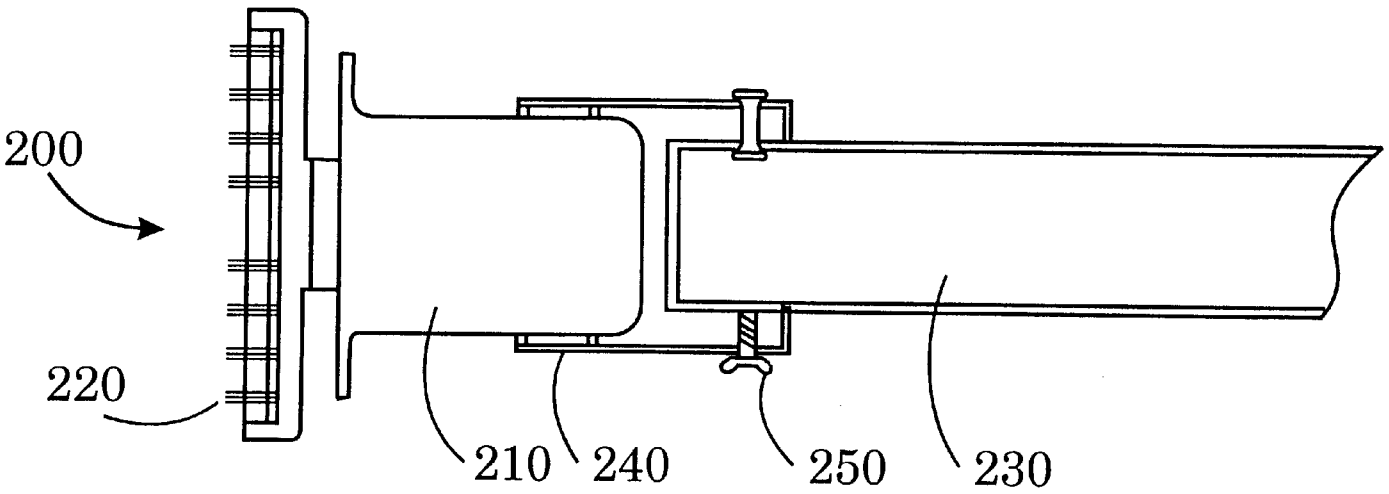
FIG. 6 is a top view of an electric cleaning device with a rotatably mounted chassis according to the present invention.
Figure 7:
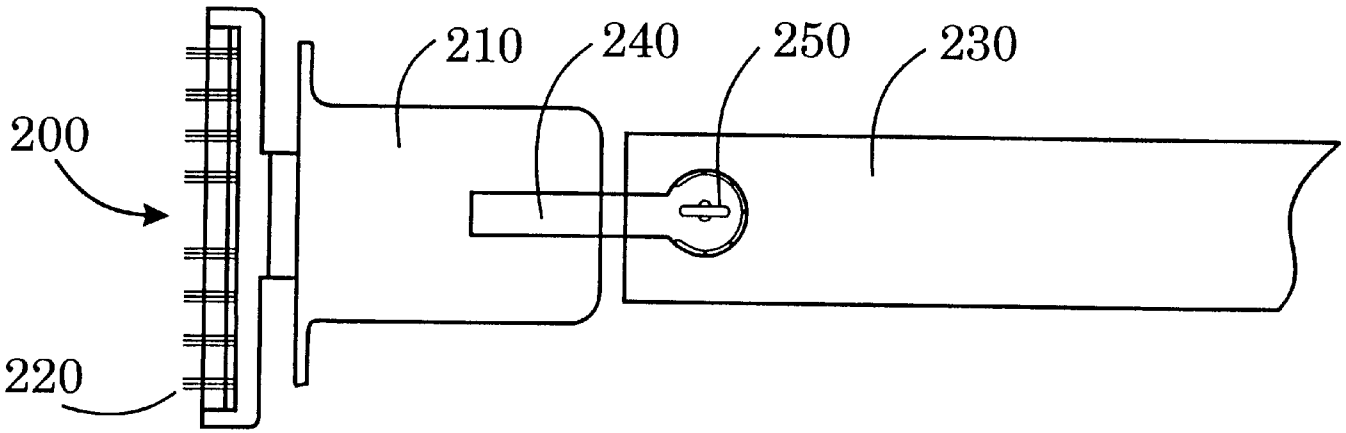
FIG. 7 is a side view of the electric cleaning device with a rotatably mounted chassis in FIG. 6.

The chassis of the electric cleaning device according to the present invention can also be designed rotatably mounted on the handle. Please refer to FIGS. 6 and 7. FIG. 6 is a top view of an electric cleaning device with a rotatably mounted chassis. FIG. 7 is a side view of the cleaning device in FIG. 6. The chassis 210 and the handle 230 of the stick-shaped electric cleaning device 200 in FIG. 5 can be installed in a rotatable manner as shown in FIGS. 6 and 7. The chassis 210 and the handle 230 are interconnected by a connecting rod 240, and fastened or released through the use of a spiral screw 250 so that the chassis 210 and the handle 230 can be adjusted to various angles.

Figure 8:
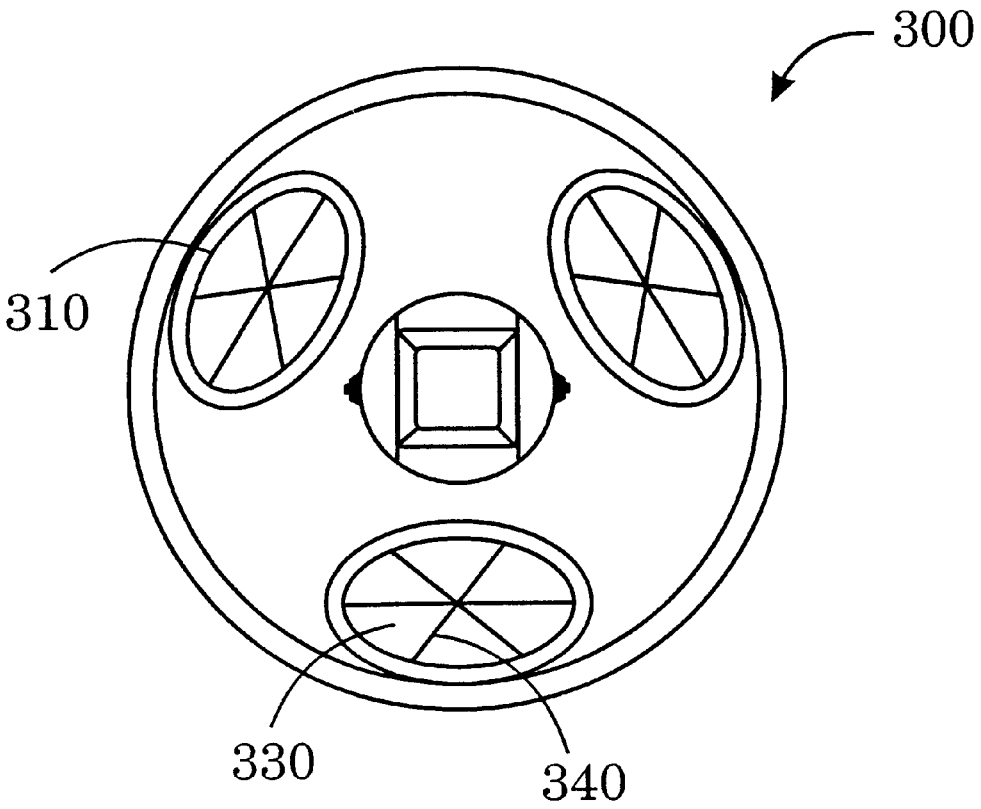
FIGS. 8 and 9 show a first embodiment of the cleaning head according to the present invention.
Figure 9:
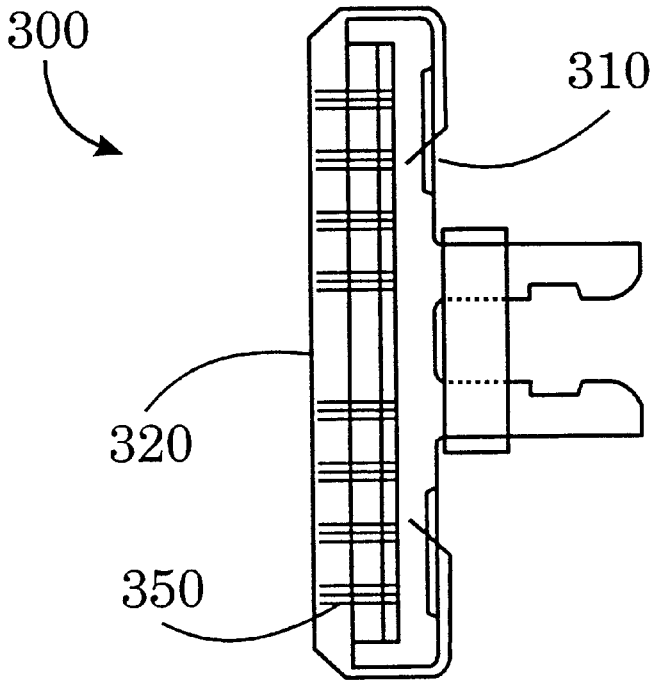
Figure 10:
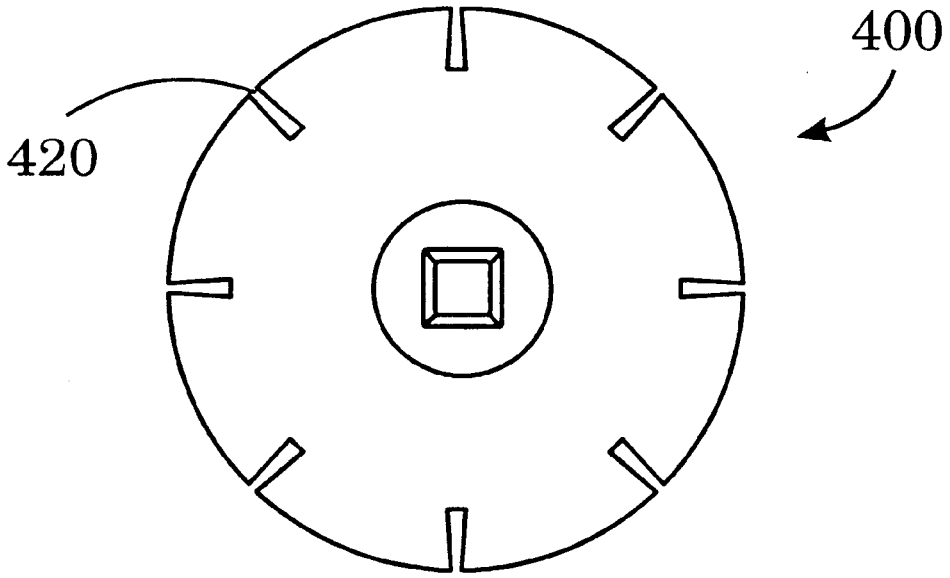
FIGS. 10 and 11 show a second embodiment of the cleaning head according to the present invention.
Figure 11:
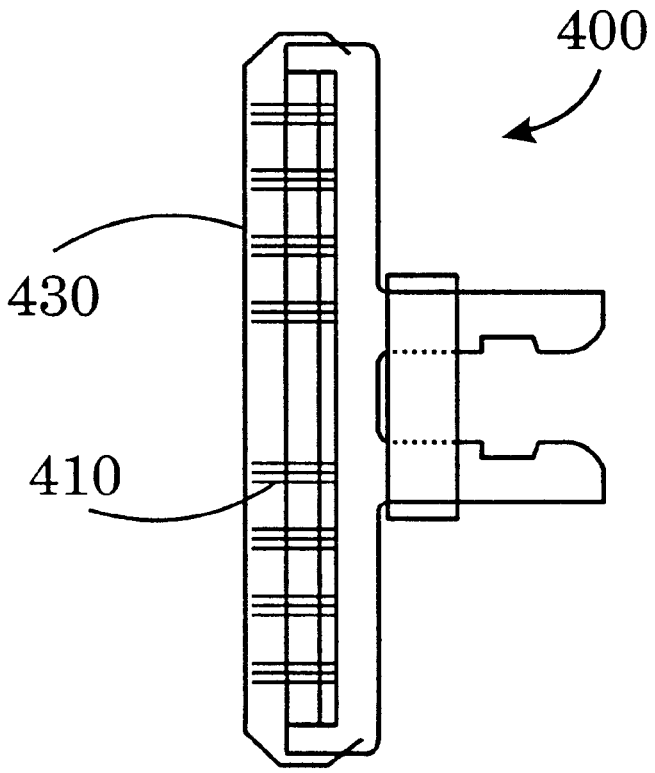
Figure 13:
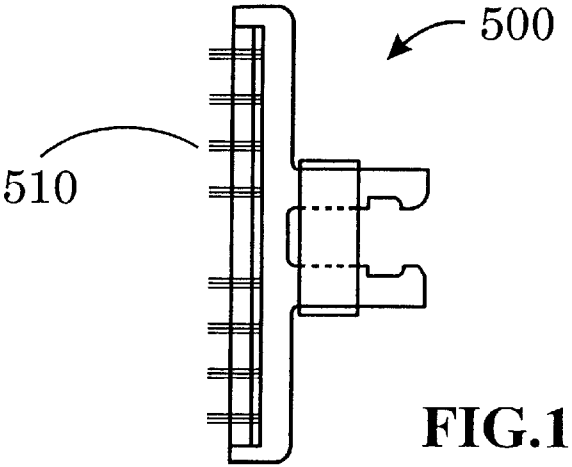
FIGS. 12 to 15 show a third embodiment of the cleaning head according to the present invention.
Figure 15:
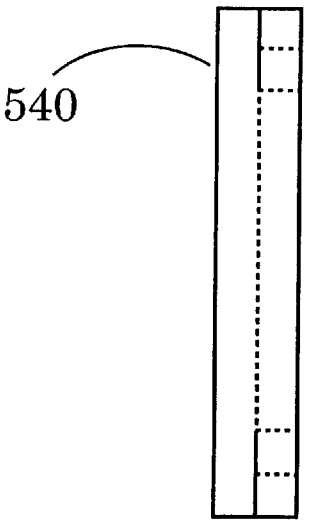
Figure 12:
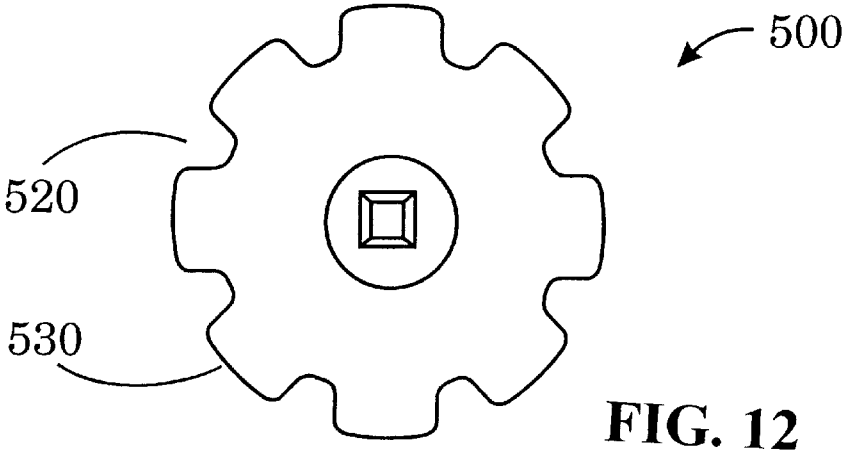
Figure 14:
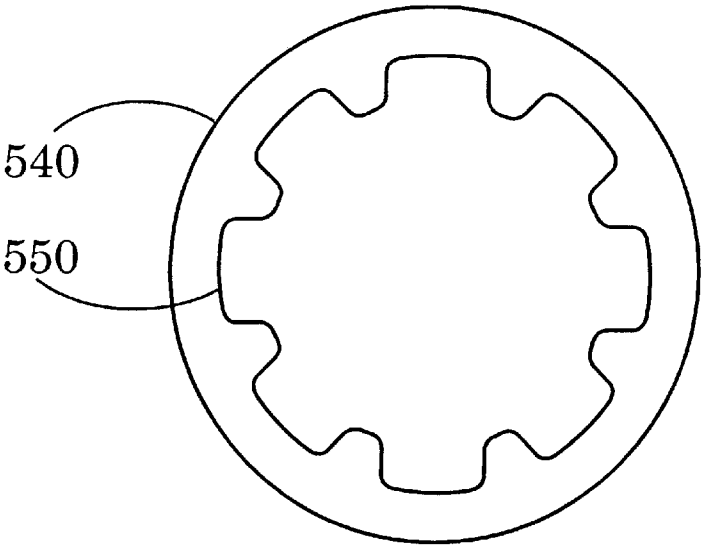
Figure 16:
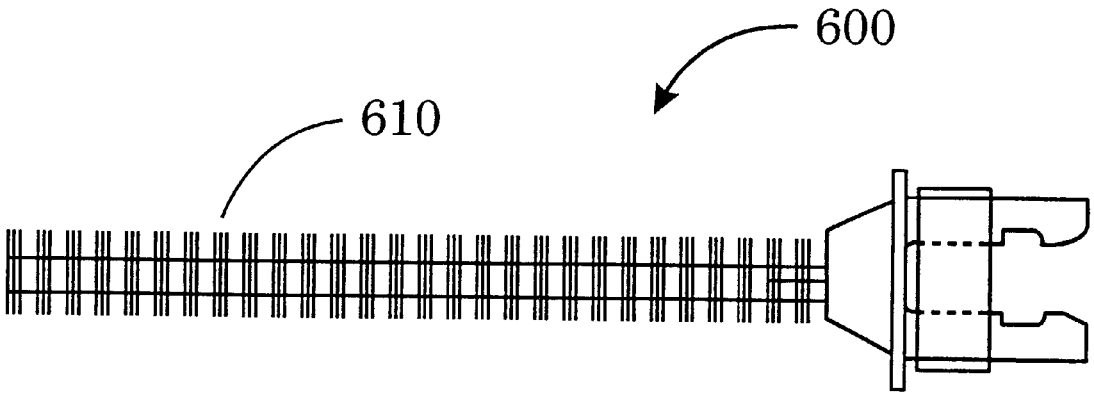
FIG. 16 shows a fourth embodiment of the cleaning head according to the present invention.
Figure 17:
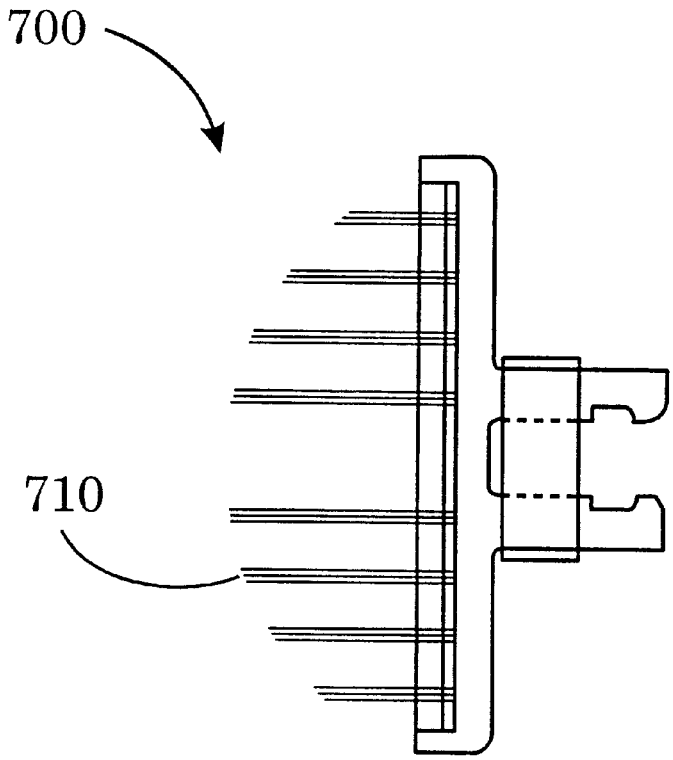
FIG. 17 shows a fifth embodiment of the cleaning head according to the present invention.
Figure 18:
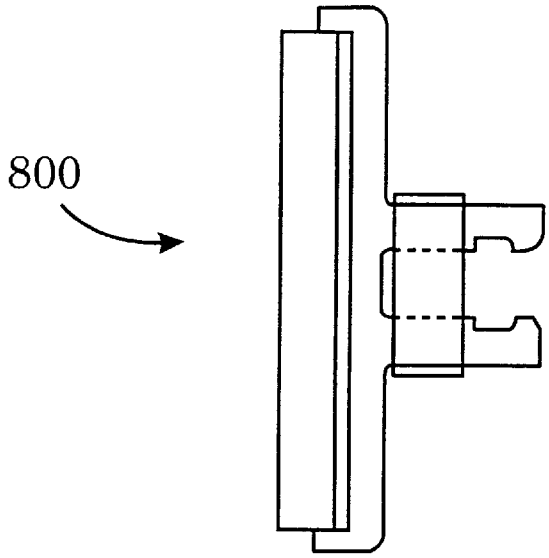
FIGS. 18 to 20 show other embodiments of the cleaning head according to the present invention.
Figure 19:
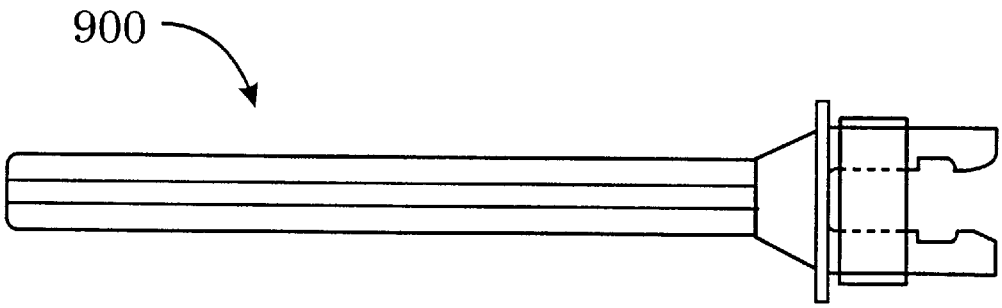
Figure 20:
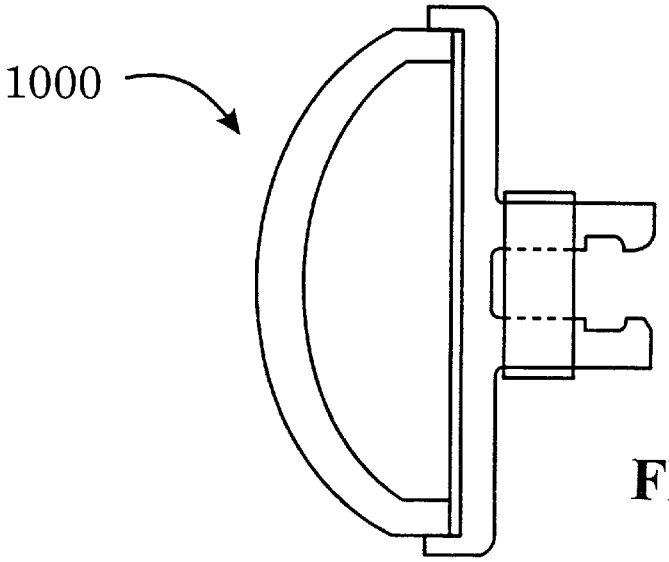

Please refer to FIGS. 8 to 20. FIGS. 8 and 9 show a first embodiment of the cleaning head 300 according to the present invention. FIGS. 10 and 11 show a second embodiment of the cleaning head 400 according to the present invention. FIGS. 12 to 15 show a third embodiment of the cleaning head 500 according to the present invention. FIG. 16 shows a fourth embodiment of the cleaning head 600 according to the present invention. FIG. 17 shows a fifth embodiment of the cleaning head 700 according to the present invention. FIGS. 18 to 20 show other embodiments of the cleaning heads 800, 900, 1000 according to the present invention. The cleaning head of the electric cleaning device comprises a variety of selections to comply with various cleaning requirements. The cleaning head 300 of FIGS. 8 and 9 is a circular shaped cleaning head 300. It comprises brushes 350 installed on its front side, and a plurality of cloth fasteners 310 installed on its rear side for fixing thin cleaning material 320 such as a cotton cloth or emery cloth. Each of the cloth fasteners 310 comprises a plurality of elastic plates 330 with narrow openings 340 between them for clamping the cleaning material 320 on the cleaning head 300. Please refer to the cleaning head 400 in FIGS. 10 and 11. As shown in FIG. 11, in addition to the brushes 410, the cleaning head 400 also comprises a plurality of narrow openings 420 for fixing thin cleaning material 430 onto the cleaning head 400. Please refer to the cleaning head 500 in FIGS. 12 to 15. Except for brushes 510, the cleaning head 500 comprises a plurality of grooves 520 forming a gear-wheel shaped edge 530 for engaging and rotating cleaning material 540 such as a scouring pad. The cleaning material 540 can be made with an indented central portion and a gear-wheel shaped inner edge 550. When the cleaning material 540 is attached to the cleaning head 500, the inner edge 550 is engaged with the gear-wheel shaped edge to secure the cleaning material 540. FIG. 15 is a side view of the cleaning material 540. FIG. 16 shows a stick-shaped cleaning head 600. It comprises a stick-shaped brush 610 for cleaning items such as glass bottles or milk bottles. FIG. 17 shows a bowl-shaped cleaning head 700 comprising brushes 710 in a bowl shape for cleaning bowl-shaped items such as bowls and bathtubs. The brushes 350, 410, 510, 610, 710 of the cleaning heads 300, 400, 500, 600, 700 can be directly replaced by items such as scouring pads, cotton cloths or emery cloths to form the cleaning heads 800, 900, 1000 as shown in FIGS. 18 to 20.

The electric cleaning device makes use of rotation of the electric cleaning head for cleaning thus requiring less manpower. The wireless design makes it light and portable. There is a wide selection of material in many shapes and sizes that can be attached to or detached from the cleaning device by hand thus offering the user a wide selection of different cleaning heads. In addition to the cleaning heads, there is also a wide variety of handles from which to choose that further increase the flexibility of the control of the cleaning device. Therefore, the portable electric cleaning device is specifically designed to solve various household cleaning problems.

Those skilled in the art will readily observe that numerous modifications and alterations of the propeller may be made while retaining the teachings of the invention. Accordingly, the above disclosure should be construed as limited only by the metes and bounds of the appended claims.

What is claimed is:

1. A portable electric cleaning device comprising:

a housing having a handle and a chassis;

a motor installed in the chassis of the housing comprising a rotating axle;

a cleaning module having a connecting end and a cleaning head for cleaning various home appliances and home environment;

a transmission element having first and second ends installed between the rotating axle of the motor and the cleaning module wherein the first end of the transmission element is mounted on the rotating axle of the motor, and the second end of the transmission element is engaged with the cleaning module so that the cleaning module can be rotated by the motor through the transmission element;

an elastic device installed between the connecting end of the cleaning module and the second end of the transmission element for absorbing disturbances caused by using the cleaning module, the elastic device comprising a buffer cap attached to the transmission element and a spring installed within the buffer cap; and a battery set installed in the housing for driving the motor so as to rotate the cleaning module.

2. The electric cleaning device of claim 1 wherein the connecting end of the cleaning module can be attached to or detached from the rotating axle by hand directly.

3. The electric cleaning device of claim 1 wherein the second end of the transmission element comprises a protruded edge, and the connecting end of the cleaning module comprises at least one elastic hook for engaging the protruded edge of the transmission element so that the connecting end of the cleaning module can be directly attached to or detached from the protruded edge by hand.

4. The electric cleaning device of claim 1 further comprising a metallic ring installed on the chassis wherein when the connecting end of the cleaning module is installed on the rotating axle, portion of the connecting end of the cleaning module will rotatably engage with the metallic ring of the chassis so as to reduce friction and to avoid wobbling of the cleaning module when it is rotated.

5. The electric cleaning device of claim 1 wherein the handle of the housing and the rotating axle of the motor are in different axial directions so that the handle can be easily held by a user for cleaning.

6. The electric cleaning device of claim 1 wherein the chassis is in an approximate circular shape and comprises a front end and a rear end wherein the cleaning module is positioned in the front end of the chassis and the handle is fixed on the rear end of the chassis so that a user can easily hold the handle during cleaning.

7. The electric cleaning device of claim 1 wherein the handle is a stick-shaped handle and fixed on the chassis at a predetermined oblique angle so that a user can easily hold the handle during cleaning.

8. The electric cleaning device of claim 7 wherein the stick-shaped handle is extendible.

9. The electric cleaning device of claim 1 wherein the handle installed on the chassis can be adjusted for changing its working angle.

10. The electric cleaning device of claim 1 wherein the cleaning head is in a circular shape.

11. The electric cleaning device of claim 10 wherein the cleaning head comprises a brush for cleaning.

12. The electric cleaning device of claim 10 wherein the cleaning head comprises scouring pads, cotton cloths or emery cloths for cleaning.

13. The electric cleaning device of claim 10 wherein the circular shaped cleaning head comprises at least one cloth fastener, the cloth fastener comprises a plurality of elastic plates for clamping cleaning material.

14. The electric cleaning device of claim 1 wherein the cleaning head comprises grooves for engaging cleaning material with a corresponding shape so as to rotate the cleaning material.

15. The electric cleaning device of claim 1 wherein the cleaning head comprises at least one narrow opening for fixing cleaning material during cleaning.

16. The electric cleaning device of claim 1 wherein the cleaning head is a stick-shaped cleaning head.

17. The electric cleaning device of claim 16 wherein the cleaning head comprises a brush for cleaning.

18. The electric cleaning device of claim 16 wherein the cleaning head comprises scouring pads, cotton cloths or emery cloths for cleaning.

19. The electric cleaning device of claim 1 wherein the cleaning head is in a bowl shape.

20. The electric cleaning device of claim 19 wherein the cleaning head comprises a brush for cleaning.

21. The electric cleaning device of claim 19 wherein the cleaning head comprises scouring pads, cotton cloths or emery cloths for cleaning.

22. The electric cleaning device of claim 1 wherein the battery set comprises at least one dry battery.

23. The electric cleaning device of claim 1 wherein the battery set comprises at least one rechargeable battery.

24. A portable electric cleaning device comprising:

a housing having a handle and a chassis;

a metallic ring installed on the chassis;

a motor installed in the chassis of the housing comprising a rotating axle;

a cleaning module having a cleaning head for cleaning various home appliances and home environment, and a connecting end installed on the rotating axle; and a battery set installed in the housing for driving the motor so as to rotate the cleaning module;

wherein both the connecting end of the cleaning module and the rotating axle comprise screw threading for engaging each other, when the connecting end of the cleaning module is screwed on the rotating axle, portion of the connecting end of the cleaning module will rotatably engage with the metallic ring of the chassis so as to reduce friction and to avoid wobbling of the cleaning module when it is rotated.

25. The electric cleaning device of claim 24 wherein the handle of the housing and the rotating axle of the motor are in different axial directions so that the handle can be easily held by a user for cleaning.

26. The electric cleaning device of claim 24 wherein the chassis is approximately in a circular shape and comprises a front end and a rear end wherein the cleaning module is positioned in the front end of the chassis and the handle is a ring-shaped handle fixed on the rear end of the chassis so that a user can easily hold the ring-shaped handle during cleaning.

27. The electric cleaning device of claim 24 wherein the handle is a stick-shaped handle and fixed on the chassis at a predetermined oblique angle so that a user can easily hold the handle during cleaning.

28. The electric cleaning device of claim 27 wherein the stick-shaped handle is extendible.

29. The electric cleaning device of claim 24 wherein the handle installed on the chassis can be adjusted for changing its working angle.

30. The electric cleaning device of claim 24 wherein the cleaning head is in a circular shape.

31. The electric cleaning device of claim 30 wherein the cleaning head comprises a brush for cleaning.

32. The electric cleaning device of claim 30 wherein the cleaning head comprises scouring pads, cotton cloths or emery cloths for cleaning.

33. The electric cleaning device of claim 30 wherein the circular shaped cleaning head comprises at least one cloth fastener, the cloth fastener comprises a plurality of elastic plates for clamping cleaning material.

34. The electric cleaning device of claim 24 wherein the cleaning head comprises grooves for engaging cleaning material with a corresponding shape so as to rotate the cleaning material.

35. The electric cleaning device of claim 24 wherein the cleaning head comprises at least one narrow opening for fixing cleaning material during cleaning.

36. The electric cleaning device of claim 24 wherein the cleaning head is a stick-shaped cleaning head.

37. The electric cleaning device of claim 36 wherein the cleaning head comprises a brush for cleaning.

38. The electric cleaning device of claim 36 wherein the cleaning head comprises scouring pads, cotton cloths or emery cloths for cleaning.

39. The electric cleaning device of claim 24 wherein the cleaning head is in a bowl shape.

40. The electric cleaning device of claim 39 wherein the cleaning head comprises a brush for cleaning.

41. The electric cleaning device of claim 39 wherein the cleaning head comprises scouring pads, cotton cloths or emery cloths for cleaning.

42. The electric cleaning device of claim 24 wherein the battery set comprises at least one dry battery.

43. The electric cleaning device of claim 24 wherein the battery set comprises at least one rechargeable battery.

44. A portable electric cleaning device comprising:

a housing having a handle and a chassis;

a metallic ring installed on the chassis;

a motor installed in the chassis of the housing comprising a rotating axle;

a cleaning module having a cleaning head for cleaning various home appliances and home environment, and a connecting end installed on the rotating axle by way of riveting, welding or joggling; and a battery set installed in the housing for driving the motor so as to rotate the cleaning module;

wherein when the connecting end of the cleaning module is installed on the rotating axle, portion of the connecting end of the cleaning module will rotatably engage with the metallic ring of the chassis so as to reduce friction and to avoid wobbling of the cleaning module when it is rotated.

45. A portable electric cleaning device comprising:

a housing having a handle and a chassis;

a motor installed in the chassis of the housing comprising a rotating axle;

a cleaning module having a circular-shaped cleaning head for cleaning various home appliances and home environment, and a connecting end installed on the rotating axle, the cleaning head comprising at least one cloth fastener having a plurality of elastic plates for clamping cleaning material; and a battery set installed in the housing for driving the motor so as to rotate the cleaning module;

wherein both the connecting end of the cleaning module and the rotating axle comprise screw threading for engaging each other so that the cleaning module is screwed on the rotating axle.

46. A portable electric cleaning device comprising:

a housing having a handle and a chassis;

a motor installed in the chassis of the housing comprising a rotating axle;

a cleaning module having a cleaning head for cleaning various home appliances and home environment, and a connecting end installed on the rotating axle, the cleaning head comprising grooves for engaging cleaning material with a corresponding shape so as to rotate the cleaning material; and a battery set installed in the housing for driving the motor so as to rotate the cleaning module;

wherein both the connecting end of the cleaning module and the rotating axle comprise screw threading for engaging each other so that the cleaning module is screwed on the rotating axle.

47. A portable electric cleaning device comprising:

a housing having a handle and a chassis;

a motor installed in the chassis of the housing comprising a rotating axle;

a cleaning module having a cleaning head for cleaning various home appliances and home environment, and a connecting end installed on the rotating axle, the cleaning head comprising at least one narrow opening for fixing cleaning material during cleaning; and a battery set installed in the housing for driving the motor so as to rotate the cleaning module;

wherein both the connecting end of the cleaning module and the rotating axle comprise screw threading for engaging each other so that the cleaning module is screwed on the rotating axle.

* * * * *